US005159140A

United States Patent [19]

Kimpara et al.

[11] Patent Number: 5,159,140

[45] Date of Patent: Oct. 27, 1992

[54] ACOUSTIC CONTROL APPARATUS FOR CONTROLLING MUSICAL TONES BASED UPON VISUAL IMAGES

[75] Inventors: Mamoru Kimpara; Takeshi Adachi, both of Hamamatsu, Japan

[73] Assignee: Yamaha Corporation, Hamamatsu, Japan

[21] Appl. No.: 565,894

[22] Filed: Aug. 9, 1990

Related U.S. Application Data

[63] Continuation of Ser. No. 242,781, Sep. 9, 1988, abandoned.

[30] Foreign Application Priority Data

| | | | |
|---|---|---|---|
| Sep. 11, 1987 | [JP] | Japan | 62-226685 |
| Sep. 25, 1987 | [JP] | Japan | 62-145370[U] |
| Oct. 2, 1987 | [JP] | Japan | 62-248123 |
| Oct. 2, 1987 | [JP] | Japan | 62-248124 |
| Oct. 2, 1987 | [JP] | Japan | 62-248125 |

[51] Int. Cl.[5] ..... G10H 1/00; G10H 7/02

[52] U.S. Cl. ..... 84/600; 84/603; 84/604; 84/DIG. 12; 84/DIG. 26

[58] Field of Search ..... 84/600-607, 84/639, 640, DIG. 12, DIG. 6, DIG. 26, DIG. 9, DIG. 19, 463, 464 R, 464 A, 465, 470 R, 477 R, 478; 340/384 R, 384 E; 434/116; 381/61, 124; 382/17, 22-25, 28, 29; 358/108, 105, 903, 93, 88, 91, 92

[56] References Cited

U.S. PATENT DOCUMENTS

| | | | |
|---|---|---|---|
| 3,928,717 | 12/1975 | Dorland | 84/464 R X |
| 4,228,716 | 10/1980 | Linford | 84/464 R X |
| 4,504,933 | 3/1985 | Janney | 84/1.01 X |
| 4,627,324 | 12/1986 | Zwosta | 84/1.01 |
| 4,658,427 | 4/1987 | Aubin | 381/124 |
| 4,681,008 | 7/1987 | Morikawa et al. | 84/1.28 |
| 4,688,090 | 8/1987 | Veitch | 358/108 |
| 4,688,460 | 8/1987 | McCoy | 84/1.18 X |
| 4,739,400 | 4/1988 | Veitch | 84/1.01 X |

FOREIGN PATENT DOCUMENTS

| | | | |
|---|---|---|---|
| 0139876 | 5/1985 | European Pat. Off. | 340/384 R |
| 2502823 | 10/1982 | France | 84/1.22 |
| 2598316 | 11/1987 | France | 340/384 R |
| 8702168 | 4/1987 | World Int. Prop. O. | 84/1.03 |

OTHER PUBLICATIONS

Kay, L. "A Non-Visual Prosthesis for the Blind-Its Operation and Evaluation", *JAEU,* vol. 5, No. 4 (1972), pp. 24-30.

*Primary Examiner*—Stanley J. Witkowski

*Attorney, Agent, or Firm*—Spensley Horn Jubas & Lubitz

[57] ABSTRACT

An acoustic control apparatus which can be applied to an electronic musical instrument controls the acoustics of a musical tone to be generated in response to variation of an image. In order to detect the variation of an image, the acoustic control apparatus extracts a predetermined image element from image information to be given thereto. This image element can be identified as movement of image, color of an image or an outline of image. The color of image can be detected by detecting hue and/or number of colors in the image. In addition, in response to periodicity in variation of this image element, a performance tempo of musical tone can be controlled.

15 Claims, 7 Drawing Sheets

ACOUSTIC CONTROL APPARATUS FOR CONTROLLING MUSICAL TONES BASED UPON VISUAL IMAGES

This is a continuation of copending application Ser. No. 242,781, filed on Sep. 9, 1988, now abandoned.

BACKGROUND OF THE INVENTION

1. Field of the Invention

The present invention relates to an acoustic control apparatus, and more particularly to an acoustic control apparatus capable of controlling or varying the acoustics, musical tone or the performance tempo in connection with an image.

2. Prior Art

As the conventional automatic performance apparatus, the automatic rhythm performance apparatus and automatic accompaniment apparatus of electronic musical instrument are known. In addition, there is another known automatic performance apparatus which automatically performs a melody accompaniment etc. based on performance data which are sequentially read in accordance with the preset tempo stored in memory means such as a magnetic tape, a punch tape, a semiconductor memory and the like.

These automatic performance apparatuses are automatically set by adequately setting the tempo by player or operator or in accordance with tempo data stored in the memory means.

For this reason, in the case where such automatic performance apparatus is used for assigning the music to desirable image, there is a disadvantage in that it demands high skill or it is impossible to match the performance tempo of the music with the movement of the image.

Meanwhile, there is no conventional apparatus which embodies the automatic control of musical tone in response to the image.

In the conventional electronic musical instrument and the like, various effects can be given to the performance tone by controlling frequency characteristic, reverberation characteristic and the like of the performance acoustics by use of the digital signal processor (DSP) or by directly controlling tone color, tone volume and the like at a tone source. Such control of performance tone is executed by manual operation of player. Therefore, there is a limit in variation of the performance contents in such control.

SUMMARY OF THE INVENTION

It is accordingly a primary object of the present invention to provide an acoustic control apparatus capable of automatically synchronizing the performance tempo with movement of a moving picture which designates the predetermined image element within the image information.

It is another object of the present invention to provide an acoustic control apparatus which can automatically control the musical tone in response to the image and which can also give delicate or specific variation to the musical tone more than that of the conventional apparatus.

In a first aspect of the present invention, there is provided an acoustic control apparatus comprising:

(a) detecting means for detecting variation of an image; and (b) acoustic control means for automatically controlling the acoustics of a musical tone to be performed in response to the detected variation of the image.

In a second aspect of the present invention, there is (a) extracting means for extracting a predetermined image element from image information;

(b) detecting means for detecting periodicity in variation of the image element; and (c) control means for controlling a performance tempo of performed musical tone in response to the detected cycle of the image element.

In a third aspect of the present invention, there is provided an acoustic control apparatus comprising:

(a) element extracting means for extracting a predetermined image element from an image signal or image information; and (b) acoustic control means for giving variation to a music information in response to the image element.

In a fourth aspect of the present invention, there is provided an acoustic control apparatus comprising:

(a) image pick-up means for picking up an image of an object;

(b) distance measuring means for measuring distance between the object and the image pick-up means;

(c) element extracting means for extracting a predetermined image element from an image signal outputted from the image pick-up means; and (d) acoustic control means for giving variation to a music information in response to the distance measured by the distance measuring means and the image element extracted by the element extracting means.

In a fifth aspect of the present invention, there is provided an acoustic control apparatus comprising:

(a) chroma detecting means for detecting hue and chroma of each picture element constituting an image from an image signal or image information;

(b) spectrum detecting means for detecting an optical spectrum of image in unit time from the detected hue and chroma of each picture element; and (c) control means for giving variation to an acoustic signal or musical tone information in response to the optical spectrum.

In a sixth aspect of the present invention, there is provided a musical tone generating apparatus comprising:

(a) input means for inputting image information;

(b) sampling means for outputting information which is obtained by sampling the image information, so that the sampling means outputs the information as waveform data;

(c) memory means;

(d) writing means for writing the waveform data into the memory means; and (e) reading means for reading the waveform data from the memory means, whereby a musical tone is to be generated based on the read waveform data.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
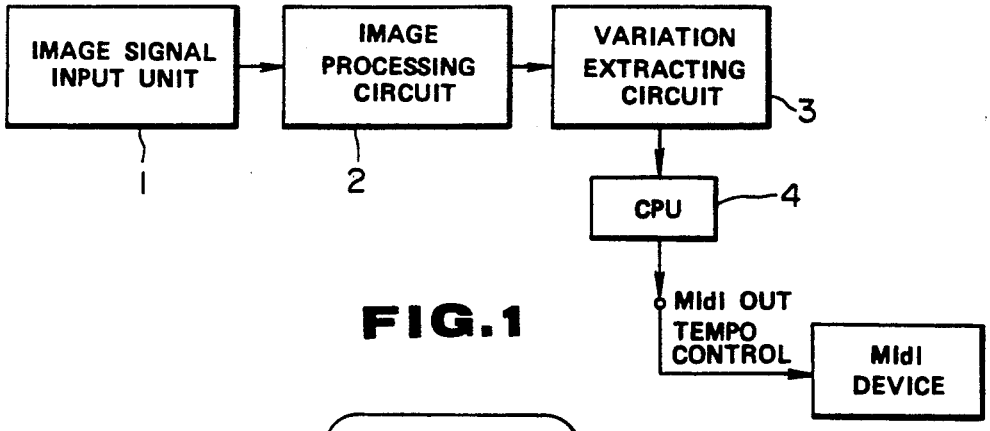
FIG. 1 is a block diagram showing diagrammatic constitution of an acoustic control apparatus according to a first embodiment of the present invention.

Hereinafter, description will be given with respect to the preferred embodiments of the present invention in conjunction with the drawings, wherein like reference characters designate like or corresponding parts throughout the several views. [A] FIRST EMBODIMENT FIG. 1 shows the constitution of the acoustic control apparatus (i.e., performance tempo control apparatus) according to the first embodiment of the present invention. This apparatus shown in FIG. 1 comprises an image signal input unit 1 for inputting an image signal which means the image information, an image processing circuit 2, a variation extracting circuit 3, a microprocessor (i.e., central processing unit; CPU) 4 and the like.

Figure 2:
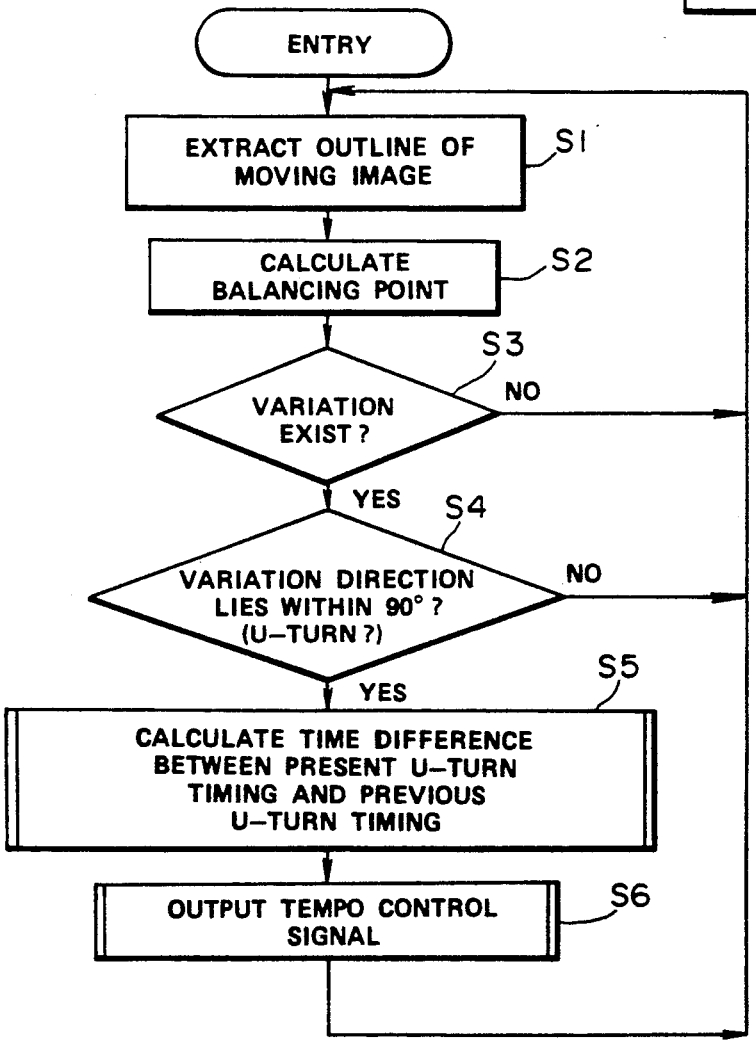
FIG. 2 is a flowchart showing an operation of the apparatus shown in FIG. 1.

Next, description will be given with respect to the operation of the apparatus shown in FIG. 1 by referring to the flowchart shown in FIG. 2.

Figure 3:
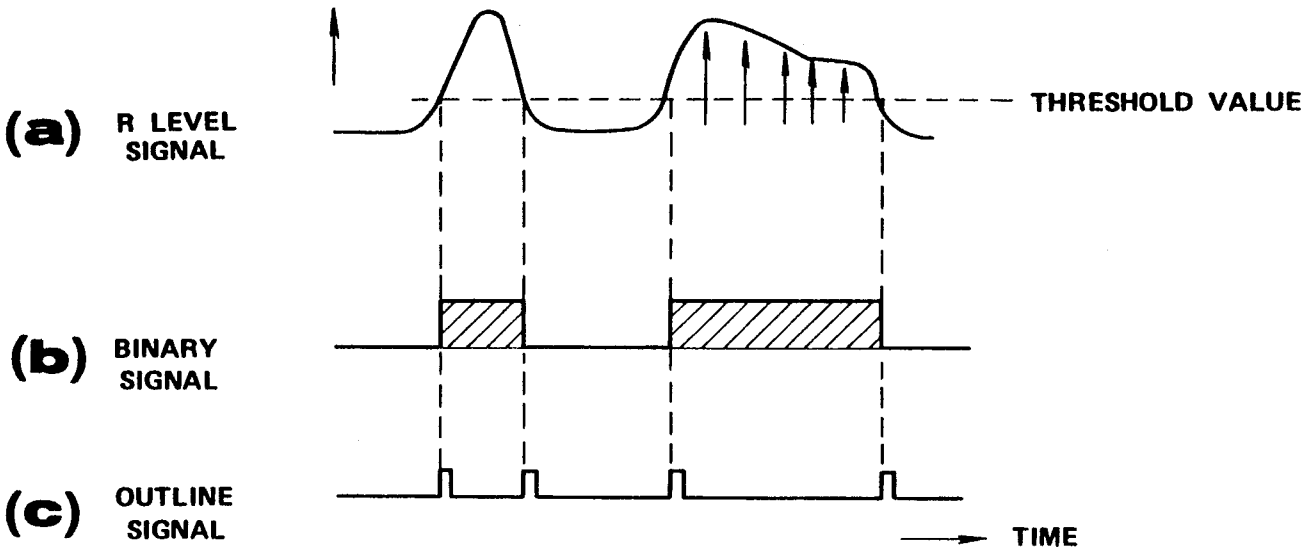
FIG. 3 shows waveforms for explaining an outline detecting operation in the apparatus shown in FIG. 1.

The image processing circuit 2 executes an operation in a step S1. More specifically, the image signal input unit 1 constituted by a television camera, a video tape recorder (VTR) or the like supplies the image signal to a dictorial image processing circuit 2 wherein color level signals of three primary colors (i.e., R (red), G (green) and B (blue) colors) are separated from the image signal. FIGS. 3(*a*) to 3(*c*) show the image process of R level signal, for example. In this case, the R level signal (shown in FIG. 3(*a*)) is digitized into a binary signal by use of a threshold value as shown in FIG. 3(*b*), and then the differentiation is effected on this binary signal so that an outline signal (which designates an outline position) as shown in FIG. 3(*c*) can be obtained.

The variation extracting circuit 3 executes an operation in a step S2. More specifically, the variation extracting circuit 3 calculates out a balancing point on area of the moving image which is surrounded by the outline designated by the outline signal outputted from the image processing circuit 2. Then, the variation extracting circuit 3 outputs balancing position data indicative of the above balancing point. Such method for calculating out the balancing point can be executed by the conventional method which is known as normal image processing technique.

Steps S3 to S6 indicate operations of the CPU 4.

Figure 4:
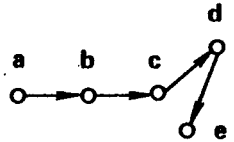
FIG. 4 is a diagram for explaining a U-turn detecting operation in the apparatus shown in FIG. 1.

The CPU 4 inputs the balancing position data from the variation extracting circuit 3 and then judges whether there is variation in the balancing point (i.e., movement variation of the balancing point) or not (in the step S3). If there is no variation of the balancing point, the processing returns to the step S1. When the balancing point moves from "a" point to "e" point as shown in FIG. 4, there must be the variation of balancing point at each of the "b" to "e" points. If there is the variation of balancing point, the CPU 4 judged that "variation exists" in the step S3. Then, the processing proceeds to the next step S4 wherein it is judged whether variation direction (or variation angle) lies within 90 degrees or above 270 degrees. Hereinafter, this variation angle will be explained by referring to FIG. 4. This variation angle can be defined as an angle of vector $\overrightarrow{bc}$ inclined against vector $\overrightarrow{ab}$ in counterclockwise direction. If the variation angle lies within 90 degrees or above 270 degrees (when the variation angle is judged at the "b" to "d" points in FIG. 4, for example), the processing returns to the step S1. If the variation angle lies above 90 degrees but within 270 degrees (at the "e" point in FIG. 4), it is judged that the moving image is U-turned. In this case, the CPU 4 calculates out time difference between preceding U-turn timing and present U-turn timing in a step S5. At a detection timing after third detection timing of U-turn, the CPU 4 executes a singular value detection and its process and the like: the present time difference is averaged with the previous time difference; or if the present time difference is extremely larger or smaller than the previous time difference, data thereof are cut. In the step S6, a tempo control signal or its data are generated based on data of above time difference in the step S6. Thereafter, the processing returns to the step S1 and then the above-mentioned operations will be repeatedly executed.

In the step S6, the tempo control signal or its data corresponding to the device or unit which is controlled by this performance tempo control apparatus are generated. For example, the tempo data of MIDI (Musical Instrument Digital Interface) standard are to be outputted to MIDI device. Meanwhile, it is possible to use this performance tempo control apparatus as a tempo generator of automatic performance apparatus by outputting the tempo clock itself.

In the case where the image signal outputted from the image signal input means 1 includes the object or image other than the moving image which is to be imaged, the image processing circuit 2 analyzes shape of the object to be imaged based on the outline data (in the step S1). Such shape analysis can be embodied by the known method described in "Shape Pattern Recognizing Technology" (written by Hidehiko Takano) which is published on Oct. 30, 1985 by Kabushiki Kaisha Jyoho Chosakai, for example. In this case, the outline data indicative of the outline of the moving image must be outputted to the variation extracting circuit 3 (in the step S2).

Meanwhile, it is possible to execute the cycle detection based on movement of a line connecting between the balancing point and the reference point set within or outside the moving image. For example, by setting the reference point within the moving point but apart from the balancing point, it is possible to detect the direction of moving image and then detect the cycle based on the direction variation of moving image.

Incidentally, the first embodiment notices the movement of moving image and then obtains the cycle. However, the method for obtaining the cycle is not limited to this method, so that it is possible to obtain cycle in color variation or brightness variation of the still or moving image.

Figure 5:
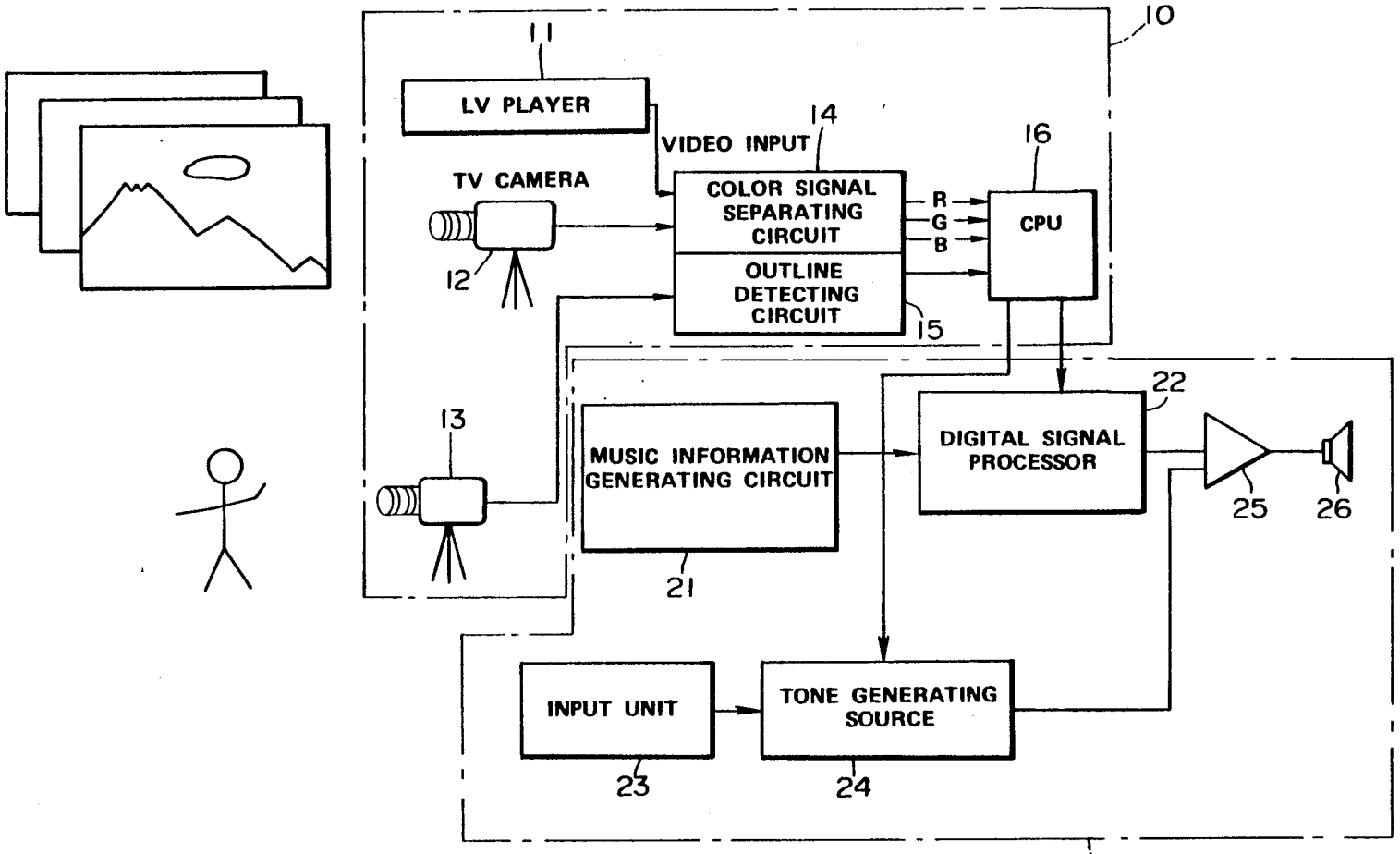
FIG. 5 is a block diagram showing constitution of an acoustic control apparatus according to a second embodiment of the present invention.

As described above, according to the first embodiment, the automatic performance is executed by the tempo corresponding to the cycle in variation of the image element. Particularly, in the case where a background video (BGV) used for dance and disco is applied as the image information, the first embodiment is advantageous in that it is possible to perform or generate the musical tone by the satisfactory tempo corresponding to the image variation. [B] SECOND EMBODIMENT FIG. 5 is a block diagram showing constitution of a musical tone performing system to which the acoustic control apparatus (or musical tone processing circuit) according to the second embodiment of the present invention is applied. This system shown in FIG. 5 comprises an acoustic control apparatus 10 according to the present invention and a music performing apparatus 20 which is constituted similar to the conventional music performing apparatus.

The acoustic control apparatus 10 provides a LV player 11, television cameras (TV cameras) 12 and 13, a color signal separating circuit 14, an outline detecting circuit 15, a microprocessor 16 and the like.

The music performing apparatus 20 provides a music information generating circuit 21, a digital signal processor (DSP) 22, an input unit 23, a tone generating source 24, an amplifier 25, a speaker 26 and the like.

Next, description will be given with respect to the operation of the system shown in FIG. 5.

In the acoustic control apparatus 10, the LV player 11 reproduces the image such as the background and the like which has been picked up in advance. The TV camera 12 picks us the background image such as natural picture or CRT picture which varies in accordance with tune or progress. On the other hand, the TV camera 13 picks up the images of player, percussive musical instrument and the like.

The color signal separating circuit 14 inputs the image signal from the LV player 11, the TV cameras 12 and 13 and then separate the color signals of R, G and B colors from the image signal. Thereafter, each color signal is converted into gradation (chroma) data of three to six bits by each picture element (dot), and such gradation data are outputted to the CPU 16.

The outline detecting circuit 15 generates the outline data indicative of the outline of object based on the color signal or gradation data outputted from the color signal separating circuit 14, and then such outline data are outputted to the CPU 16.

The CPU 16 extracts image element based on the gradation data and outline data respectively outputted from the color signal separating circuit 14 and outline detecting circuit 15. Then, the CPU 16 calculates out to generate a musical tone control parameter corresponding to the extracting result thereof, and such musical tone control parameter is outputted to the DSP 22 and tone generating source 24 within the music performing apparatus 20.

In the music performing apparatus 20, the music information generating circuit 21 includes the microphone and amplifier for receiving voices and musical instrument tones by the player and singer plus voices and clapping sounds by the audience; a voice circuit of the LV player; and an acoustic input device such as the record player, tape recorder and the like (not shown). This circuit 21 generates and outputs analog music information to the DSP 22.

The DSP 22 is similar to the conventional processor which controls the frequency characteristic and reverberation characteristic (i.e., sound field effect). This DSP 22 converts the analog music information generated from the music information generating circuit 21 into a digital signal. Then, the DSP 22 executes the operation process corresponding to the musical tone control parameter inputted from the CPU 16 in the acoustic control apparatus 10 on the digital signal. Thereafter, the DSP 22 converts the digital signal into the analog signal again to thereby generate the musical tone signal, which will be outputted to the amplifier 25.

Meanwhile, the input unit 23 is constituted by a keyboard, percussive musical instrument or the like.

The tone generating source 24 generates a musical tone signal corresponding to key-depression information supplied from the input unit 23, and this musical tone signal is outputted to the amplifier 25. As this tone generating source 24, it is possible to use the known tone generating source which applies the waveform memory reading method, higher harmonic wave synthesizing method, frequency modulation (FM) method, frequency dividing method and the like. In this tone generating source 24, pitch and envelope waveform, spectrum of harmonic wave, operation parameters, dividing rate and the like are controlled in accordance with the musical tone control parameter supplied from the CPU 16, so that the variation corresponding to the image element is given to the musical tone signal to be generated.

The amplifier 25 amplifies the musical tone signals (i.e., the analog signals) supplied from the DSP 22 and tone generating source 24. The speaker 26 is driven by this amplifier 25 so that the above-mentioned musical tone signal is converted into the acoustics and the musical tone is generated.

In the conventional music performing system such as the electronic musical instrument and LV player, the variation such as the reverberation characteristic is given to the musical tone based on panel operation by the player or appreciator. On the contrary, the system shown in FIG. 5 has the biggest feature in that the image element is extracted and thereby the musical tone is automatically varied based on the extracting result.

The following controls (i) and (ii) between the image element and musical tone element (which is the controlled system) can be embodied, for example.

(i) At first, color balance in one whole screen of image is detected. If area of warm colors is larger, the higher tone pitches are emphasized so that the musical tone will be controlled to have cheerful tone color. On the contrary, if area of cool colors is larger, the musical tone is controlled to have dark tone color.

(ii) The outline and number of colors are detected. If the image has complicated shape or the number of colors is large, the musical tone having the strong touch and large bender is controlled to be generated. On the contrary, if the image has monotonous shape or the number of colors is small, the musical tone having the weak touch is controlled to be generated.

Next, description will be given with respect to hue control of the second embodiment. As shown in FIG. 3(*a*) described before, the gradation data of R, G and B colors are digitized by use of the predetermined threshold value. Then, number of picture elements each having the color level which is over the threshold value is counted by each color (see the hatched area in FIG. 3(*b*)). If the counted number of R color is large, the present image is judges as the warm colored image. If the counted number of B color is large, the present image is judged as the cool colored image. In addition, combination of the gradation data of R, G and B colors in each picture element is detected, so that the number of colors used in one screen will be detected. As the easiest method, the following method for counting the number of colors can be applied, for example: the color of each picture element is represented by three-bit data (which take decimal value from "0" to "7") in which three binary value data of R, G and B colors are arranged; and thereby number of colors is counted by counting the number of colors each appeared in more than 10% of picture elements within one screen.

Figure 6:
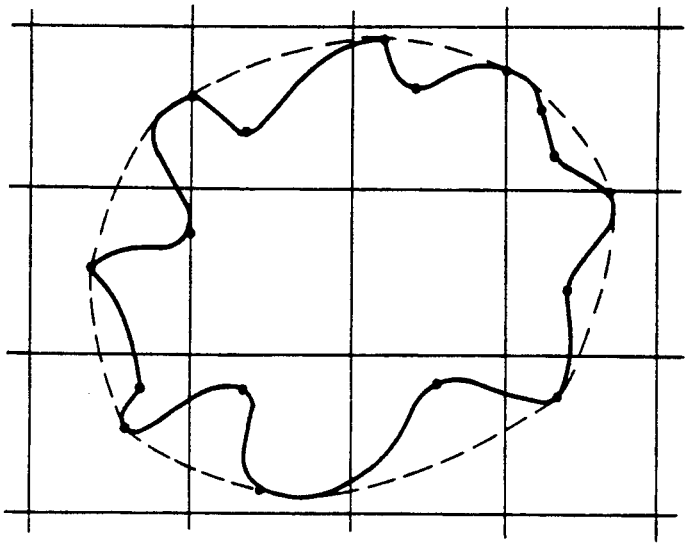
FIG. 6 is a diagram for explaining method for detecting complication degree of the outline of figure.
Figure 8:
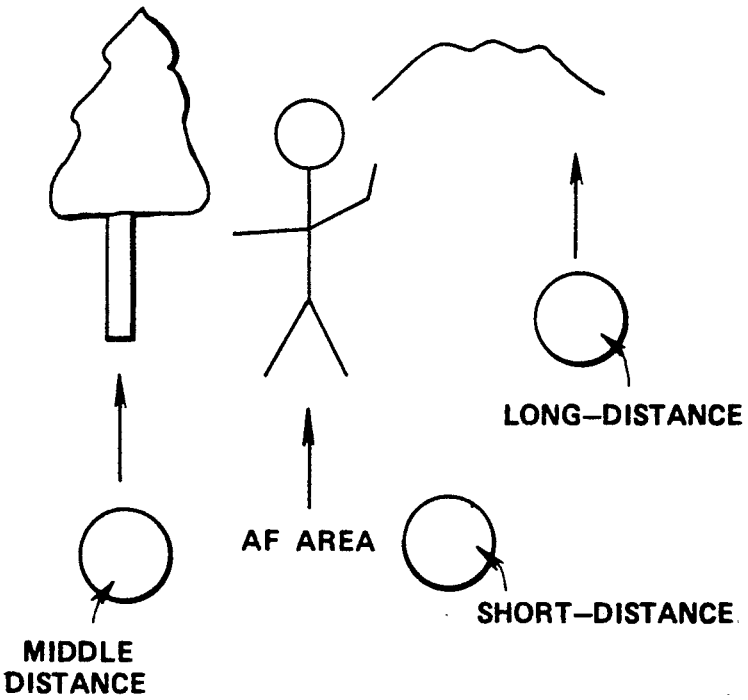
FIG. 8 is a view for explaining relation between an imaged object and AF area.

On the other hand, positions (i.e., addresses) where the three binary value data of R, G and B colors are varied are detected as the outline as shown in FIG. 3(*c*). The CPU 16 analyzes the shape of object to be imaged based on this outline data. Complication degree of the outline can be obtained by counting number of displacement points (i.e., "." marks in FIG. 6) within certain area. Or, it is possible to detect the complication degree of first figure surrounded by the solid line in FIG. 6 by detecting ratio between areas of this first figure and second figure (which is surrounded by dotted line connecting tops of concave portions of the first figure) plus number of these tops of concave portions.

Therefore, according to the second embodiment, visual sense can be expressed in response to the acoustics. For, example, it is possible to perform or listen to the musical tones having several variations by giving the variation to the image even in the same music. In addition, it is possible to embody the performance having the delicate or specific variation, which is difficult or impossible to be embodied by the manual operation.

Further, in the case where this acoustic control apparatus according to the second embodiment is equipped to the electronic musical instrument and the image indicative of appearance of the audience is displayed in concert hall, the present embodiment also has the effect in that the musical tone of the electronic musical instrument can be automatically varied in response to the movements of the audience (e.g., clapping, hand-beating, stepping, shaking movements of the audience). [C]

THIRD EMBODIMENT

Figure 7:
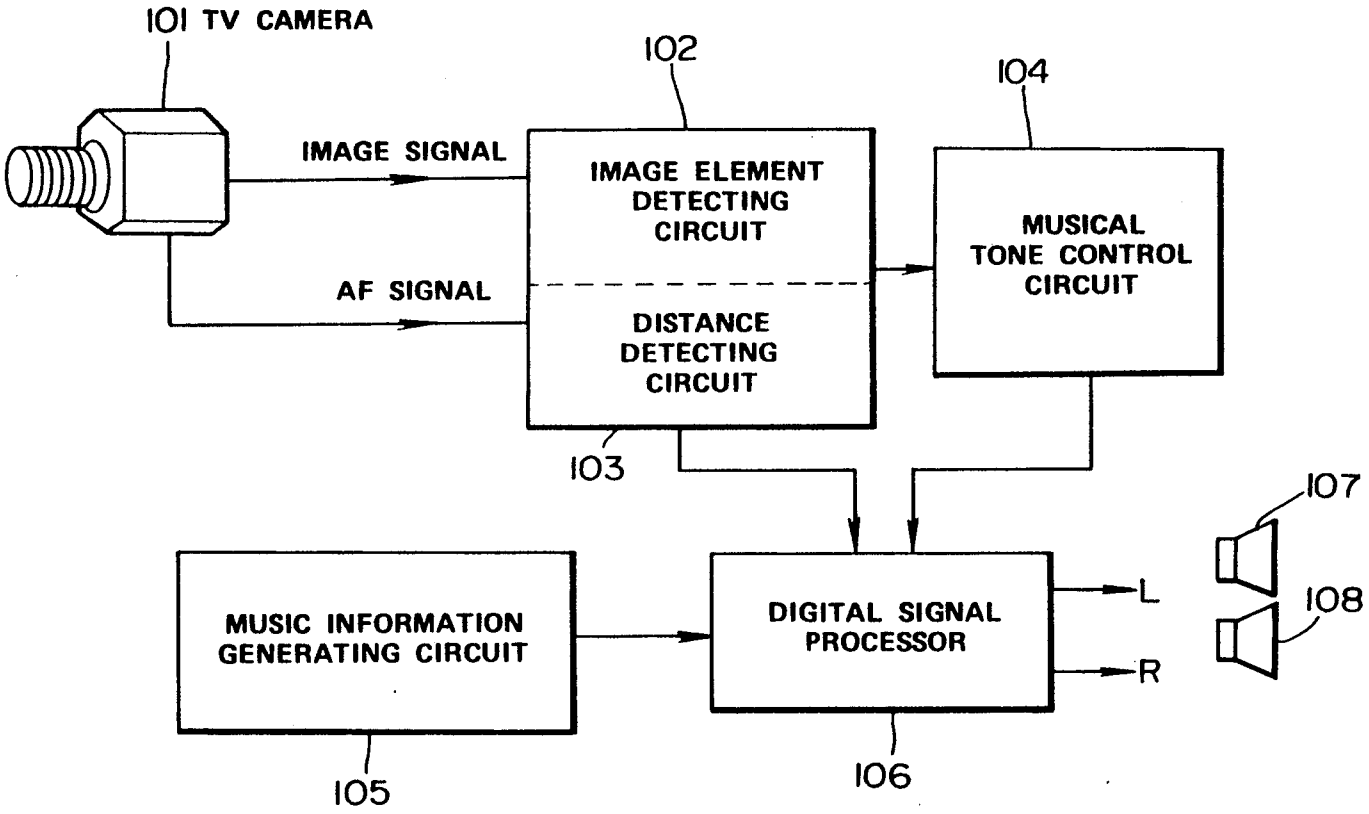
FIG. 7 is a block diagram showing diagrammatic constitution of an acoustic control apparatus according to a third embodiment of the present invention.

Next, description will be given with respect to the third embodiment of the present invention. FIG. 7 shows constitution of the acoustic control apparatus according to the third embodiment.

The acoustic control apparatus (or musical tone processing apparatus) shown in FIG. 7 provides a TV camera 101 equipping with the automatic focusing unit, an image element detecting circuit 102, a distance detecting circuit 103, a musical tone control circuit 104, an acoustic information generating circuit 105, a DSP 106 and the like.

Hereinafter, description will be given with respect to the operation of this apparatus shown in FIG. 7.

The TV camera 101 adjusts the focus of lens to the imaged object in an auto-focus (AF) area to thereby pick up the image of object. The TV camera 101 outputs an auto-focus (AF) signal and image signal at this time.

Based on this image signal outputted from the TV camera 101, the image element detecting circuit 102 detects area ratio of the imaged object against the background image (which means the other area of the AF area), hue and outline of the AF area, and then this circuit 102 outputs these detecting information to the musical tone control circuit 104.

The distance detecting circuit 103 detects the distance between the TV camera 101 and the AF area (i.e., the imaged object) based on the AF signal, and then this circuit 103 outputs control parameter data corresponding to this distance to the DSP 106.

The musical tone control circuit 104 operates the control parameter data corresponding to image element detecting information outputted from the image element detecting circuit 102, and then this circuit 104 outputs parameter data to the DSP 106.

The music information generating circuit 105 is constituted by the voice circuit such as the microphone plus amplifier or the LV player; the acoustic device such as the record player and tape recorder; or the electronic musical instrument such as a guitar synthesizer. This circuit 105 outputs the analog music information to the DS 106.

The DSP 106 is similar to the DSP 22 described before. More specifically, the DSP 106 converts the analog music information generated from the music information generating circuit 105 into the digital signal. Then, the DSP 106 gives the variation to the digitized music information by executing the operation process corresponding to the control parameter data supplied from the distance detecting circuit 103 and musical tone control circuit 104. Thereafter, the DSP 106 converts the varied digital signal into the analog signal again, whereby the varied acoustic signal will be generated. This acoustic signal is outputted to speakers 107 and 108 vi an amplifier (not shown).

In contrast with the conventional music performing apparatus described before, the apparatus shown in FIG. 7 has the biggest feature in that this apparatus extracts the image element and the distance to the imaged object and then automatically varies the musical tone based on the extracting result.

Next, description will be given with respect to the relation between the distance to the imaged object, the image element and the musical tone element (which is the controlled system). For example, this distance is classified into three stages of long-distance, middle-distance and short-distance. Then, the reverberation quantity is controlled to large, middle and small quantity respectively corresponding to the long-distance, middle-distance and short-distance. Thus, it is possible to express the distance to the imaged object as depth feeling of tone. In addition, if the area ratio of AF area is large, the stereophonic and surrounding feelings are controlled to be large. On the other hand, if the area ratio of AF area is small, the acoustics is processed to be monophonic. Thus, it is possible to express the size of the AF area or the imaged object as expanse feeling of tone. Further, the hue of the AF area is detected to thereby control the tone color. For example, if the number of warm colors is large, the high tone pitch is stressed so that the generated musical tone will have the cheerful tone color. On the other hand, if the number of cool colors is large, the generated musical tone is controlled to have the dark tone color. Furthermore, the outline of the AF area or imaged object is detected. If the outline has the complicated shape, the musical tone having large distortion which gives the listener a glared feeling is to be generated. If the outline has the monotonous shape, the musical tone which gives the listener the mild and round feeling is to be generated.

Meanwhile, the outline detection can be embodied as similar to that of the first or second embodiment. In addition, it is possible to calculate out the area ratio by accumulating the distances (or times) between the outlines by each scanning line in one screen. On the other hand, the complication degree of the outline can be obtained as similar to that of the second embodiment described before.

As described heretofore, according to the third embodiment, it is possible to express the musical tone in response to the image such that the distance can be felt as the variation of music. For example, when the image of running and approaching car is picked up, it is possible to change the distance feeling to the expanse feeling of tone by controlling the tone volume, reverberation characteristic or surround volume of the musical tone.

[D] FOURTH EMBODIMENT

Figure 9:
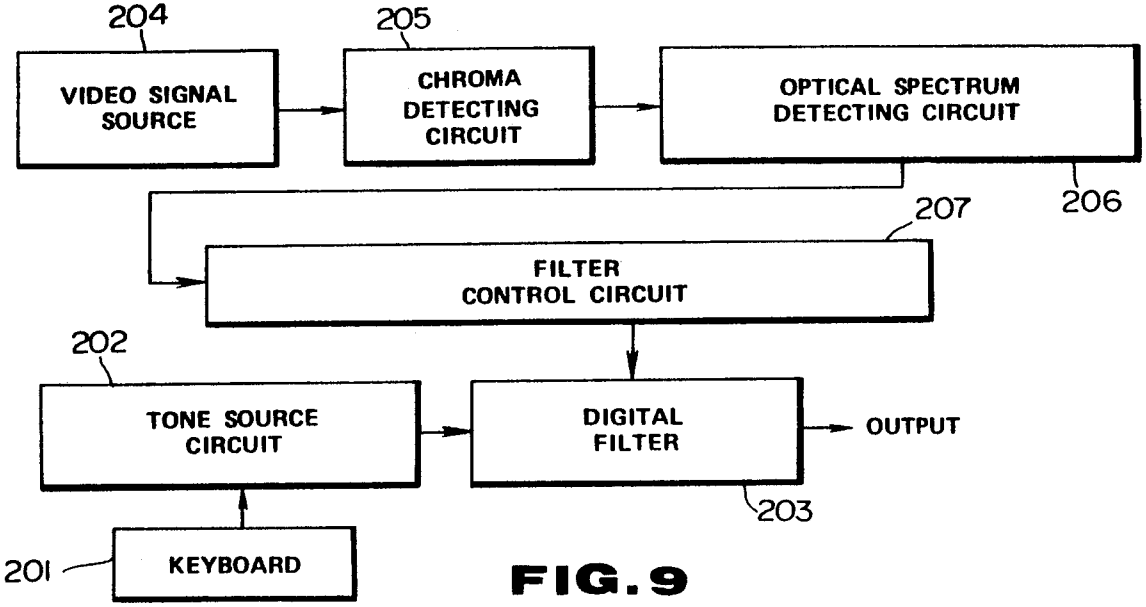
FIG. 9 is a block diagram showing diagrammatic constitution of an acoustic control apparatus according to a fourth embodiment of the present invention.

Next, description will be given with respect to the acoustic control apparatus (or acoustic processing apparatus) according to the fourth embodiment. FIG. 9 shows constitution of an embodiment of the electronic musical instrument to which the acoustic control apparatus according to the fourth embodiment is applied. This electronic musical instrument shown in FIG. 9 provides a keyboard 201; a tone source circuit 202 which generates the musical tone signal having the frequency corresponding to the tone pitch designated by the keyboard 201 and also including higher harmonic tones; a digital filter 203 used as a tone color adjusting circuit; a video signal source 204 such as the TV camera or VTR; a chroma detecting circuit 205; an optical spectrum detecting circuit 206; and a filter control circuit 207.

Next, description will be given with respect to the operation of the apparatus shown in FIG. 9.

The keyboard 201 generates the key data indicative of the depressed key thereof. The tone source circuit 202 generates the musical tone signal having the tone pitch corresponding to the above key data and also including the harmonic tone (or harmonic wave) component corresponding to the output of the tone color selecting circuit (not shown).

Meanwhile, the chroma detecting circuit 205 separates the color signals of three primary colors (i.e., R, G and B colors) from a video signal supplied from the video signal source 204. Then, the chroma detecting circuit 205 detects the color level, i.e., the chroma by each color.

The optical spectrum detecting circuit 206 integrates each color signal inputted from the chroma detecting circuit 205 by every unit time to thereby detect the integration level (i.e., optical spectrum) of each color signal within the unit time. As the unit time, it is possible to adequately select the unit time such as one cycle period of horizontal synchronizing signal of the image or cycle period of one screen (i.e., 1/30 second in case of the NTSC method). In addition, by extracting the video signal of desirable period within each horizontal period by plural horizontal periods, it is possible to extract one part from one screen and then detect the optical spectrum of the whole extracted part.

Figure 10:
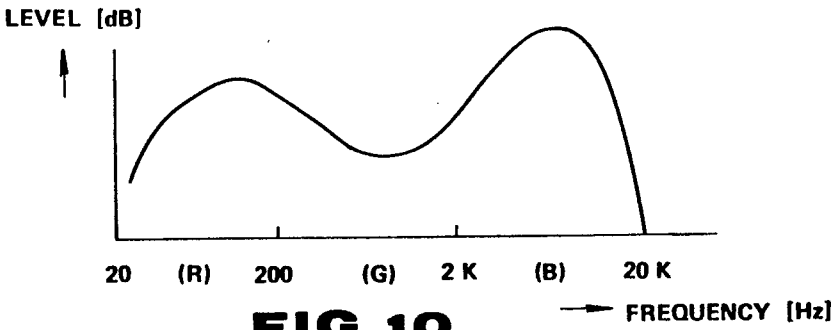
FIG. 10 shows a characteristic of a digital filter used in the apparatus shown in FIG. 9.

Meanwhile, the filter control circuit 207 is designed to output control data for controlling the characteristic of the digital filter 203 in response to the integration level of each color signal which is inputted thereto from the optical spectrum detecting circuit 206. As shown in FIG. 10, the frequency band of the digital filter 203 is divided into three frequency bands, i.e., low frequency band (20 Hz to 200 Hz), middle frequency band (200 Hz to 2 kHz) and high frequency band (2 kHz to 20 kHz). In this case, passing characteristic of low-band is controlled in response to the integration level of R color; passing characteristic of middle-band is controlled in response to the integration level of G color; and passing characteristic of high-band is controlled in response to the integration level of B color. In other words, the filter control circuit 207 controls the characteristics of the digital filter 203 in accordance with the chroma of video signal, so that the filter control circuit 207 will control the tone color of the musical tone signal which is filtered out from the digital filter 203.

In the present fourth embodiment, the digital filter 203 works as the low-pass filter in the image mainly colored by the red color; the digital filter 203 works as the band-pass filter in the image mainly colored by the green color; and the digital filter 203 works as the high-pass filter in the image mainly colored by the blue color.

As a result, in the apparatus shown in FIG. 9, the musical tone signal (i.e., audio signal) is controlled in accordance with the chroma of the video signal.

Incidentally, the constitution of fourth embodiment is not limited to that described heretofore, so that it is possible to modify the fourth embodiment as follows. For example, the fourth embodiment indicates the electronic musical instrument to which the present invention is applied. By replacing the keyboard 201 and tone source circuit 202 by the record player, tape recorder or microphone and amplifier, it is possible to vary the tone colors of all acoustic signals. In addition, it is possible to use the digital signal processor instead of the digital filter 203. In this case, it is possible to add the sound field effects by using such as the equalizer and reverberation apparatus to the acoustic signal such as the musical tone signal, and it is also possible to vary these sound field effects. Further, it is possible to remove the digital filter from the apparatus shown in FIG. 9 so that several kinds of parameters of the tone source circuit 202 will be directly controlled in response to the optical spectrum. In this case, it is possible to control frequency, tone color, tone volume and the like of the musical tone as well.

Therefore, according to the fourth embodiment, it is possible to express the tone in response to the variation of image. For example, it is possible to generate the musical tone whose tone color is varied in accordance with average chroma of the video input signal within unit time.

[E] FIFTH EMBODIMENT

Figure 11:
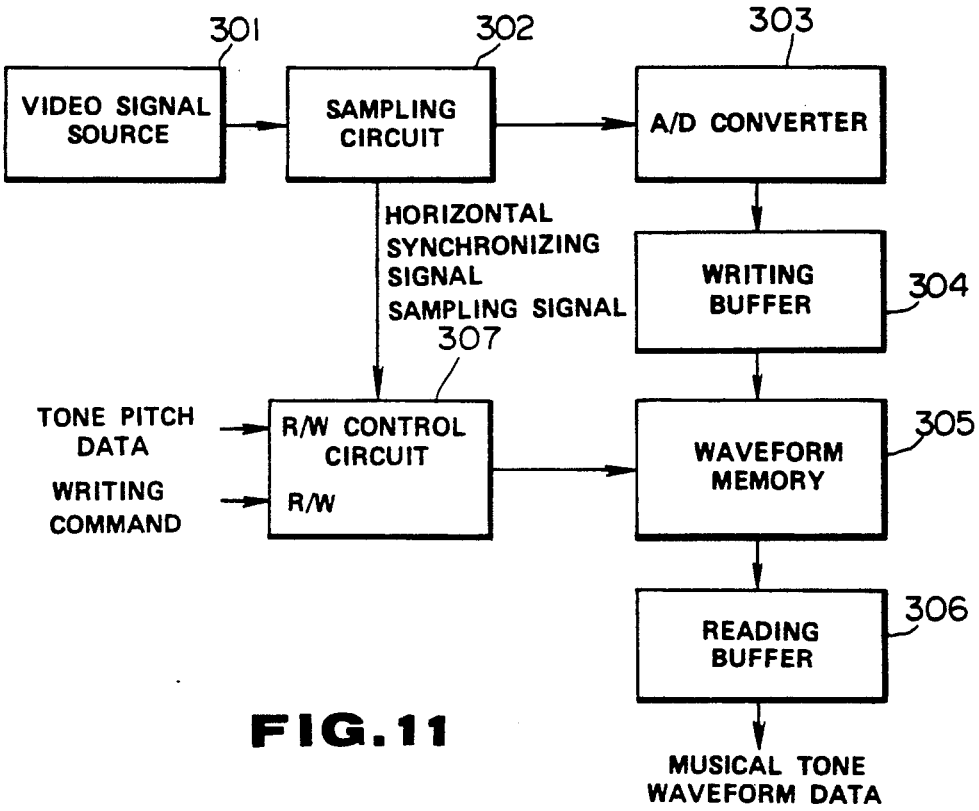
FIG. 11 is a block diagram showing diagrammatic constitution of an acoustic control apparatus according to a fifth embodiment of the present invention.
Figures 12A, 12B:
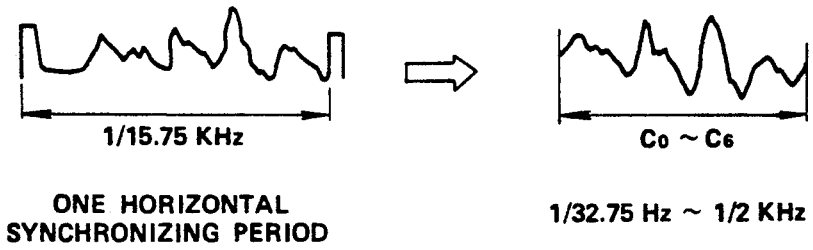
FIGS. 12A and 12B show input and output waveforms of the apparatus shown in FIG. 11.

Lastly, description will be given with respect to the fifth embodiment of the present invention. FIG. 11 shows constitution of the acoustic control apparatus (i.e., tone source of musical tone generating apparatus) according to the fifth embodiment of the present invention. The apparatus shown in FIG. 11 provides a video signal source 301 for outputting the video signal as the image information, a sampling circuit 302, an analog-to-digital (A/D) converter 303, a writing buffer 304, a waveform memory 305, a reading buffer 306 and a reading/writing (R/W) control circuit 307. For example, sampling of n (where n denotes an integral number) sample points is executed on the video signal of one horizontal synchronizing period as shown in FIG. 12A, so that waveform data as shown in FIG. 12B can be obtained. Then, this waveform data are outputted as the musical tone waveform data.

Next, description will be given with respect to the operation of the apparatus shown in FIG. 11.

The sampling circuit 302 inputs the video signal from the video signal source 301 such as the TV camera and VTR and then executes the sampling on the inputted video signal, wherein this circuit 302 includes a gate which opens and closes in accordance with sampling pulse. This sampling pulse is synchronous with the horizontal period signal of the video signal. If there are n sample points within one period of the horizontal synchronizing signal, the sampling pulse has the frequency of n × 15.75 kHz.

More specifically, this sampling circuit 302 samples and holds n video sampling signals corresponding to peak values of the video signal within gate-open period in one horizontal scanning period of the video signal.

The A/D converter 303 converts these video sample signals into video sample data, which are outputted to the writing buffer 304 as waveform data.

The writing buffer 304 temporarily stores this waveform data until the next waveform data are inputted thereto.

In this case, writing command is inputted to the R/W control circuit 307 from the CPU of the electronic musical instrument body (not shown) in waveform data writing period. Thus, at the same time when the horizontal synchronizing signal is inputted to the R/W control circuit 307, the R/W control circuit 307 sets the address pointer (not shown) at the head address in the waveform memory 305. When first sampling is executed, the video sample data temporarily stored in the writing buffer 304 are written into the waveform memory 305 at the address designated by the address pointer. Thereafter, the address pointer is stepped and then the R/W control circuit 307 stands by until the next sampling is executed. Similarly, at every time when each of n samplings is sequentially executed, the R/W control circuit 307 repeatedly executes the writing to the waveform memory 305 and the stepping of the address pointer. Thereafter, when the next horizontal synchronizing signal is inputted to the R/W control circuit 307, this circuit 307 completes the above-mentioned writing operation. Thus, the waveform data corresponding to the video signals of one screen are written into the waveform memory 305.

Incidentally, in the case where the video signal of interlace method (i.e., interlaced scanning) is used, the first horizontal synchronizing signal of even field is detected and then the address pointer is stepped. In this case, in both cases of the odd field and even field, the value of address pointer is incremented by two after writing the waveform data. At this time, the above-mentioned writing operation is executed for continuous two fields, i.e., one frame (screen).

On the other hand, the tone pitch data are inputted to the R/W control circuit 307 from the CPU of the electronic musical instrument body when the waveform data are read out. The R/W control circuit 307 sequentially steps the address pointer at speed corresponding to the tone pitch designated by the tone pitch data, and waveform data are read from the waveform memory 305 at the address designated by the contents of address pointer. Thereafter, the R/W control circuit 307 repeatedly executes the above-mentioned sequences so that the waveform data will be sequentially read from the waveform memory 305 until musical tone generation stop command (i.e., key-off data) is inputted thereto.

Then, the video sample data read from the waveform memory 305 are outputted to the electronic musical instrument body as the musical tone waveform data via the reading buffer 306. In this electronic musical instrument, the envelop is given to the musical tone waveform data, and then the processes such as the mixing and digital-to-analog (D/A) conversion are executed on this musical tone waveform data. Thereafter, this data are passed through an audio circuit (not shown), from which the corresponding acoustics will be generated.

As described heretofore, by using the image signal within the horizontal synchronizing signal as one or half cycle waveform of the musical tone, it is possible to generate the musical tone waveform corresponding to the variation of screen. Thus, it is possible to correspond the screen with the tone.

Incidentally, the above-mentioned fifth embodiment indicates an example in which the video signal of one screen corresponds to the musical tone signal of one or half waveform. However, in case of the moving image, it is possible to write the average value of the video signal of one screen or one field into the waveform memory 305 as its one or plural write data, for example. In this case, the movement of image within several minutes is expressed within one waveform of the musical tone. In addition, the utilizing field of the fifth embodiment is not limited to the electronic musical instrument only, but it is possible to use the fifth embodiment in more wider field such as the game material which utilizes both of the image (i.e., visual sense) and the musical tone (i.e., audio sense).

Above all is the description of the preferred embodiments of the present invention. This invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. An acoustic control apparatus comprising:

(a) extracting means for extracting a predetermined image element from pictorial image information containing plural image elements, said predetermined image element undergoing variation relative to other image elements of said pictorial image information;

(b) detecting means for detecting periodicity in the relative variation of said predetermined image element; and (c) control means for controlling a performance tempo of a musical performance in response to the detected periodicity of said predetermined image element.

2. An acoustic control apparatus according to claim 1, wherein said detecting means calculates out a balancing point in image area of said image element sot hat said detecting means detects said periodicity in variation of said image element based on movement of the calculated balancing point.

3. An acoustic control apparatus according to claim 1, wherein sad detecting means calculates out a balancing point in image area of said image element so that said detecting means detects said periodicity in variation of said image element based on movement of a line which connects between said calculated balancing point and a reference point.

4. An acoustic control apparatus according to claim 1, wherein said extracting means includes separating means for separating color information of said image element from said image information and means for detecting a variation point where a position of said color information varies, whereby said extracting means extracts a continuous line formed by the variation points as an outline of a moving image.

5. An acoustic control apparatus according to claim 1, wherein said extracting means separates color level signals of three primary colors from said image information and then converts each color level signal into a binary signal, which is thereafter differentiated so that an outline signal indicative of an outline of image is obtained, whereby said extracting means extracts said predetermined image element as said outline signal.

6. An acoustic control apparatus according to claim 1, wherein said relative variation of said predetermined image element corresponds to a state of movement of a part or whole parts of a man or an object.

7. AN acoustic control apparatus as in claim 1, wherein the pictorial image information is a video signal from a video source.

8. An acoustic control apparatus comprising:

(a) image pick-up means for picking up a pictorial image of an object;

(b) distance measuring means for measuring the distance between said object and said image pick-up means;

(c) element extracting means for extracting a predetermined image element from an image signal outputted from said image pick-up means; and (d) acoustic control means for giving variation to a music information in response to said distance measured by said distance measuring means an din response to said image element extracted by said element extracting means.

9. An acoustic control apparatus according to claim 8, wherein said element extracting means comprises:

(a) detecting means for detecting said image element from said image signal; and (b) means for operating and outputting control parameter data in response to the detected image element, whereby said acoustic control means gives the variation to said music information in response to said distance and said control parameter data.

10. An acoustic control apparatus according to claim 8, wherein said image pick-up means is a television camera and said distance measuring means is an automatic focus detecting unit.

11. An acoustic control apparatus according to claim 9 wherein said element extracting means extracts an area ratio between an image background and an object image, color of partial or whole image and/or an outline of said object in the image obtained by said image pick-up means.

12. An acoustic control apparatus according to claim 11 wherein said color is average hue and/or number of colors.

13. An acoustic control apparatus according to claim 8, wherein the acoustics to be controlled is one or more of tone color, tone volume, frequency characteristic, reverberation characteristic and acoustic effect of said musical tone.

14. A musical tone generating apparatus comprising:

(a) input means for inputting pictorial image information;

(b) sampling means for outputting information which is obtained by sampling said image information, so that said sampling means outputs said information as waveform data;

(c) memory means for storing said waveform data;

(d) writing means for writing said waveform data into said memory means; and (e) reading means for reading said waveform data from said memory means, whereby a musical tone is to be generated based on the read waveform data.

15. An acoustic control apparatus as in claim 14 wherein the input means is a video source for providing video signals s the pictorial image information.

* * * * *